United States Patent [19]

Monnier

[11] Patent Number: 4,627,894

[45] Date of Patent: Dec. 9, 1986

[54] METHOD OF MANUFACTURING A BODY MOLDED FROM A PLASTICS MATERIAL AND COVERED WITH A METALLIC LAYER

[75] Inventor: Michel J. Monnier, Montgeron, France

[73] Assignee: U.S. Philips Corporation, New York, N.Y.

[21] Appl. No.: 645,896

[22] Filed: Aug. 31, 1984

[30] Foreign Application Priority Data

Sep. 7, 1983 [FR] France ..... 83 14254

[51] Int. Cl.[4] ..... C25D 1/20

[52] U.S. Cl. ..... 204/4

[58] Field of Search ..... 204/3, 4, 9

[56] References Cited

U.S. PATENT DOCUMENTS

| | | | |
|---|---|---|---|
| 3,947,348 | 3/1976 | Schabernack | 204/9 |
| 3,954,568 | 5/1976 | DuPree | 204/9 |
| 4,067,782 | 1/1978 | Bailey | 204/9 |

OTHER PUBLICATIONS

I.B.M. Technical Disclosure Bulletin, vol. 14, No. 1, Jun. 1971, p. 60.

*Primary Examiner*—T. M. Tufariello

*Attorney, Agent, or Firm*—Robert J. Kraus

[57] ABSTRACT

A method of manufacturing a molded body, such as an aerial, of a plastic material covered with a metallic layer according to which an intermediate layer for facilitating removal from the mold has been previously formed on the surface of the mold. The metallic layer is deposited in the mold before the plastic material is introduced. The mold (3 and 4) is metallic, and the intermediate layer is formed by passivation of the metal. A metallic coating layer (15) is then deposited in the mold by an electrolytic method and the plastic material (50) is introduced into the mold thus prepared. Finally, after hardening of the plastic material removal from the mold is effected by applying a thermal treatment.

8 Claims, 9 Drawing Figures

METHOD OF MANUFACTURING A BODY MOLDED FROM A PLASTICS MATERIAL AND COVERED WITH A METALLIC LAYER

BACKGROUND OF THE INVENTION

The invention relates to a method of manufacturing a body moulded from a plastic material covered with a metallic layer, which is applied in the manufacture of flat hyperfrequency aerials composed of radiating elements with microstrip lines associated with a dielectric substrate.

Such aerials are described in French patent applications Ser. Nos. 82 18 700 and 83 06 650 filed by Applicants on Nov. 8, 1982 and Apr. 22, 1983, respectively.

For receiving or transmitting a signal having a single polarization, such aerials comprise two metal plates in which are provided on the one hand apertures directed towards the propagation medium, constituting the radiation elements, and on the other hand a pattern of grooves destined to receive central conductors. The control conductors, supported by a dielectric film enclosed between the two metal plates, constitute, with the radiation elements and the grooves, the supply network of the aerial. The total surface area of such aerials may be from a few square centimeters to several square meters.

Such aerials are of increasing interest due to the fact that they find their application in the reception of television emissions relayed by satellite. Various other structures of flat aerials have been proposed in the last few years, but they do not fulfil the conditions imposed by the specifications of the C.C.I.R. (Comité Consultatif International de Radio), while the flat aerials manufactured according to the above patent applications have low losses, a high gain and a wide pass-band in the wavelength ranges in question.

In these conditions it is imperative to provide a manufacturing method permitting the manufacture of such aerials in large quantities at low cost. In fact, the applications in the field of television reception always imply large scale manufacture for a range of products showing a satisfactory ratio between the quality and the price.

Therefore it is advantageous in the manufacture of such aerials to replace the metal plates by metallized plastic plates, at the same time giving the assembly a great resistance to wear and weather conditions.

To effect this the present invention relates more in particular to a method of manufacturing a body moulded from a plastic material and coated with a metallic layer, according to which an intermediate layer for facilitating removal from the mould has previously been formed at the surface of the mould; the metallic layer is deposited in the mould before the plastic material is introduced.

It is known from British Pat. No. 1167690 published on Oct. 22, 1969, to manufacture such bodies from metallized plastic. The method suggested by the British Pat. specification includes covering a wooden mould with a first layer of polyvinyl alcohol which is destined to promote the removal from the mould and which will be eliminated during operation. A metallic layer is then pulverized on the polyvinyl alcohol in the mould thus prepared and the plastic body is injection-moulded. It then suffices to dissolve the polyvinyl alcohol layer to obtain the plastic body covered with the metallic layer.

Such a method has the disadvantage, already previously mentioned in this document, that only a small number of bodies can be manufactured. Moreover, the polyvinyl alcohol layer provided to avoid the adherence of the metal layer to the mould, does not enable molding, with high precision dimensions, the details of the moulded body. In effect it does not have a uniform thickness over a large surface. Also the method described in the British specification does not enable the manufacture of bodies of large dimensions.

SUMMARY OF THE INVENTION

It is an object of the present invention to mitigate the above-mentioned disadvantages while proposing a method of manufacturing such aerials as defined in the opening paragraph. According to the invention, the mould is metallic, the intermediate layer is formed by passivation of the metal, and the metallic coating layer is then deposited in the mould by an electrolytic method and the plastic material is introduced in the mould thus prepared. After hardening of the plastic material the removal from the mould is effected by applying a thermal treatment dependent on the coefficients of expansion of the respective materials constituting the mould and the plastic material.

In an embodiment of the method according to the invention the mould is manufactured by machining a solid metallic body and its surface is polished electrolytically.

In another embodiment of the method according to the invention the mould is manufactured from stamped sheet metal.

In each of these embodiments of the method according to the invention the plastic material may be a thermohardening resin and may be poured in the mould. The plastic material may also be a thermoplastic resin and may be injected in the mould while hot.

In a method according to the invention the mould is made of an alloy of iron-nickel-chromium, it is passivated chemically and the thermal treatment used for the removal from the mould is a cooling treatment.

In another embodiment of the method according to the invention the mould is of aluminium passivated by an oxide layer and the thermal treatment used for the removal from the mould is a heating treatment.

In each of these embodiments of the method according to the invention the metallic coating layer may be of a composition of copper, or silver, or gold, with nickel.

In these conditions, due to the use of a conductive mould, the operations of polishing and metal deposition may be carried out by means of an electrolytic method, which permits manufacturing on the one hand bodies of large dimensions and on the other hand a plurality of bodies at the same time.

Above all, however, it is important that the passivating layer of the metal of the mould does not change the dimensions of the latter and that in this case the precision of the dimensions of the details of the moulded body is the same as the precision for the realization of the mould. In fact, the layer formed by passivation of the metal of the mould does not constitute an intermediate layer between the mould and the moulding but forms an integral part of the mould. Consequently, and in particular in the case of a mechined mould, the precision obtained for the moulded body may be extremely great, which may be required during the manufacture of certain types of hyperfrequency aerials. Finally, the mouldings manufactured from the same mould can be repeated several times.

The quality of the members is hence improved by the method according to the invention and the manufacture thereof is simplified and accelerated.

BRIEF DESCRIPTION OF THE DRAWING

The invention will now be described in greater detail, by way of example, with reference to the accompanying drawing, in which.

DESCRIPTION OF THE PREFERRED EMBODIMENTS

Figure 1A:
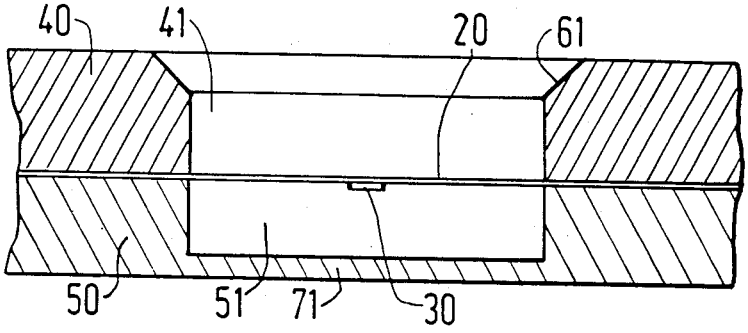
FIG. 1*a* is a diagrammatic sectional view of a radiation element of a flat aerial as described in patent application Ser. No. 82 18 700 filed by Applicants on Nov. 8, 1982.
Figure 1B:
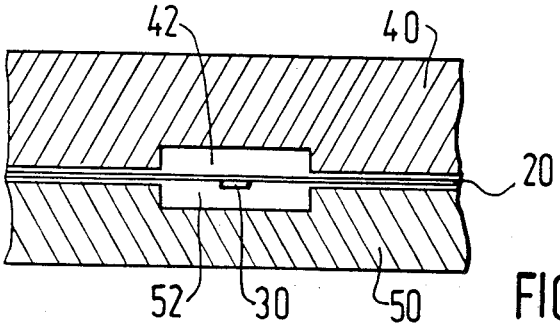
FIG. 1*b* is a diagrammatic sectional view of a supply line of such an aerial.
Figure 1C:
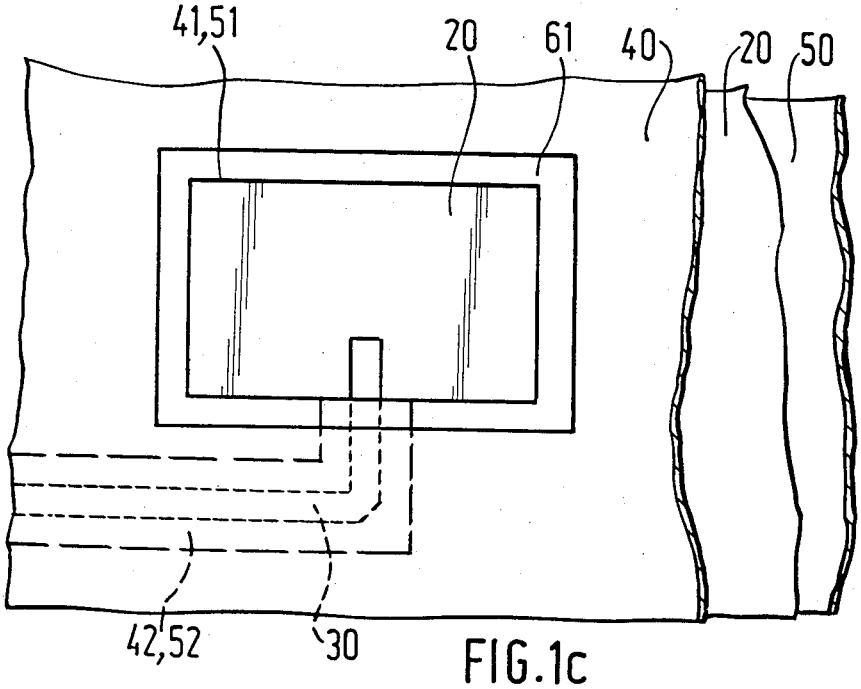
FIG. 1*c* is a view from the rear of a part of such an aerial.
Figure 2A:
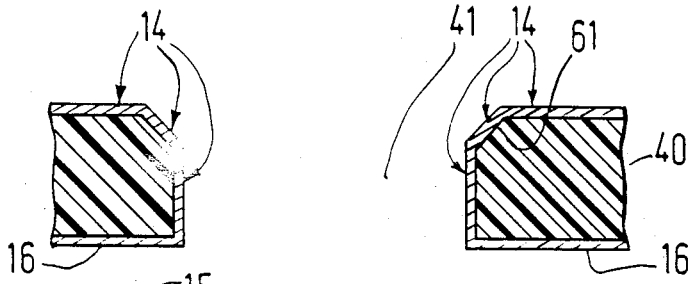
FIGS. 2*a*, 2*b*, 2*c* and 2*d* are diagrammatic sectional views of the plates of the aerial obtained by the method according to the invention.
Figure 2B:
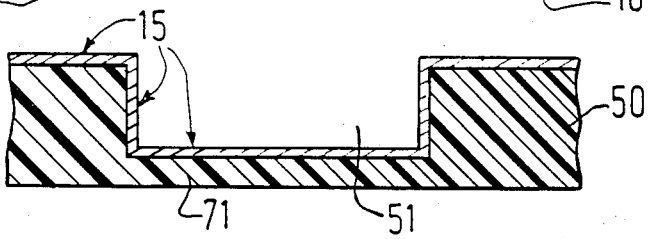
Figure 2C:
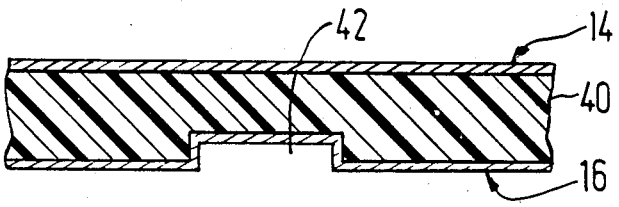
Figure 2D:
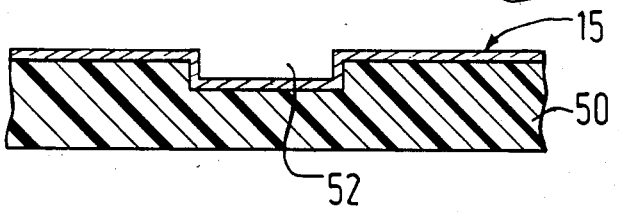

As shown in FIGS. 1*a* and 1*c*, the radiation element of the flat aerial is composed of two metallic plates 40 and 50 in which apertures 41 and 51 are provided opposite each other. The two plates enclose the dielectric sheet 20 supporting the central conductor 30. The flare 61 is provided to improve the gain, and the flat reflector 71 is provided to improve the adaptation. The central conductors 30 extend towards the output of the aerial in the grooves 42 and 52 provided in the plates 40 and 50, respectively, and shown in the sectional view of FIG. 1*b*.

All the surfaces of the aerial along which the signal to be transmitted or to be emitted propagates, must be metallized. The only surface which need not necessarily be metallized is hence the rear face of the aerial which is not turned towards the medium of propagation. For the plate 40, for example, it is necessary to metallize the surfaces 14 and 16, while for the plate 50 it is sufficient to metallize the surface 15 as is shown in FIGS. 2*a*, 2*b*, 2*c* and 2*d*.

The manufacture of the flat aerial by means of the method according to the invention is carried out in the manner shown in FIGS. 3 and 4. This manufacture comprises the formation of the two plates 40 and 50 by means of moulds specially provided for each of the bodies.

Each of the moulds may be obtained from a machine solid metallic member which is shown in FIG. 3 or from stamped sheet metal which is shown in FIG. 4. The use of a metallic material for the manufacture of the mould is made necesary due to the fact that the greater part of the operations performed on the mould according to the present invention are preferably of the electrolytic type.

Figure 3A:
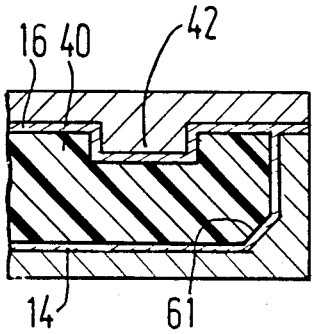
FIGS. 3*a* 3*b*, and 3*c* are diagrammatic sectional views of the moulding of the aerial plates in the case where the mould used is of machined metal.
Figure 3B:
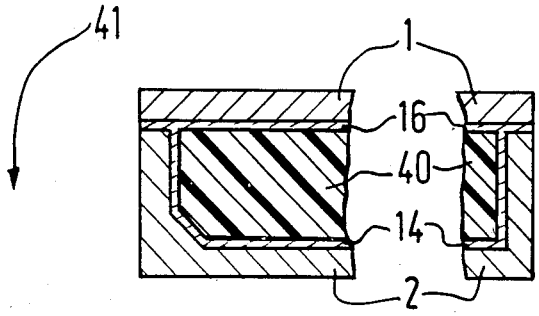

In a first embodiment of the method according to the invention the mould is machined. For the manufacture of the plate 40 it comprises two parts 1 and 2 as is shown in FIGS. 3*a* and 3*b*. After machining, each of the parts constituting the mould is polished, preferably by an electrolytic method. Said parts 1 and 2 are then passivated in such manner that the metallic layer which is deposited thereon afterwards cannot adhere to it. By way of example, if the metal chosen for realizing the mould is steel, the passivation is obtained by the action of hot nitric acid. If the metal chosen is aluminium the passivation is done by anodic oxidation.

Each part of the mould thus prepared receives a metallic deposit preferably by an electrolytic method, consisting of a metal having electrolytical properties on the one hand and being compatible with the operation of a higher frequency aerial on the other hand. Therefore, a composition of copper, or silver, or gold, with nickel is preferably chosen.

It is to be noted that the metallic layer manufactured by an electrolytic method is deposited both on the inside and on the outside of the mould. In order to diminish waste of the electrolytic bath, the outside of the mould is preferably covered by a layer of lacquer, for example permitting to avoid said deposit.

In each of the embodiments of the method according to the invention, electrolytic methods are preferred to any other form as giving the best results on the large surfaces presented by the aerials. The electrolytic etching permits on the one hand to obtain an excellent state of the surface on very large bodies and on the other hand the electrolytic deposit provides layers which are particularly uniform and homogeneous. Moreover, the results can excellently be repeated in the case of series manufacture. Finally, numerous bodies may be treated at a time, which is also favourable for series production.

A plastic material or synthetic resin is then introduced between the members 1 and 2 of the mould. The resin may be of the thermohardening or thermoplastic type and, as the case may be, it may be moulded or injected. For the moulding and/or the curing of such a resin it is never necessary to raise the temperature of the mould up to the fusion temperature of the metal layer, so this does not risk any deterioration.

After hardening of the resin, the removal from the mould is carried out by separating the members 1, 40 and 2. If the metallic material constituting the mould has a coefficient of expansion smaller than that of the resin, the removal from the mould is obtained by means of a thermal treatment consisting of a cooling of the members, which produces a shrinkage of the plastic member. The latter is ejected, taking the metal layer along. This type of operation is used in the case where the metallic material used for the mould is, for example, an alloy of iron-nickel-chromium of the type Invar.

On the other hand, if the metallic material constituting the mould has a coefficient of expansion which is higher than that of the resin, which is the case if the mould is, for example of aluminium, the removal from the mould is obtained by means of a thermal treatment consisting of a heating which produces an expansion of the mould and the working loose of the plastic member which is ejected taking the metal layer along.

Another advantage of the method resides in the fact that the mould may be re-used a great number of times.

Figure 3C:
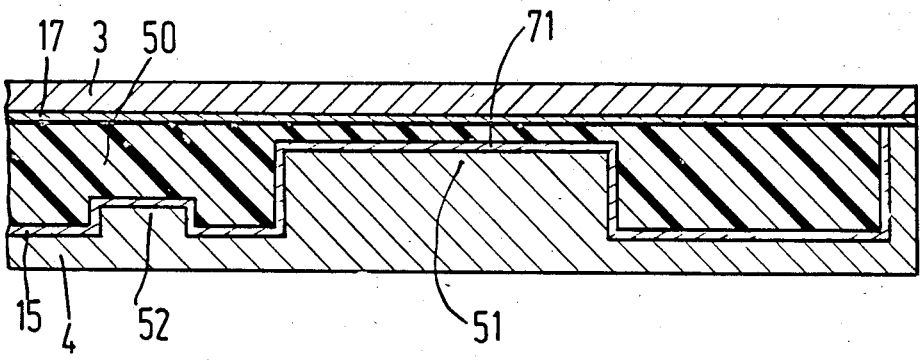

For the manufacture of the plate 50 by means of a machined mould the latter comprises two parts 3 and 4 as shown in FIG. 3*c*. Since only the surace 15 of the body 50 has to be metallized, only the part 4 of the mould receives the metallization. The member 3 may be constitited of any material, metallic or not, in such manner that its surface 17 does not adhere to the member 50 of resin. If the surface would adhere to the resin, it could remain adhered thereto and would by no means deteriorate the operation of the aerial. However, a new part 3 of the mould would have to be provided for each manufactured aerial, which is not desired because this would increase the cost of manufacture. The part 3 of the mould may hence be provided, for example, of Teflon or even metal and be coated with a lacquer.

Moulding and removing from the mould of the member 50 of the aerial are then carried out in the same manner as described for member 40.

Figure 4A:
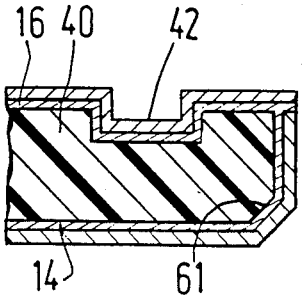
FIGS. 4*a*, 4*b* and 4*c* are diagrammatic sectional views of the moulding of the aerial plates in the case in which the mould used is of stamped sheet metal.
Figure 4B:
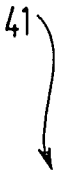
Figure 4B:
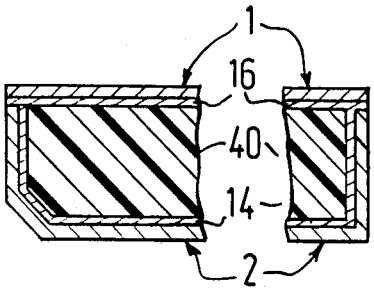
Figure 4C:
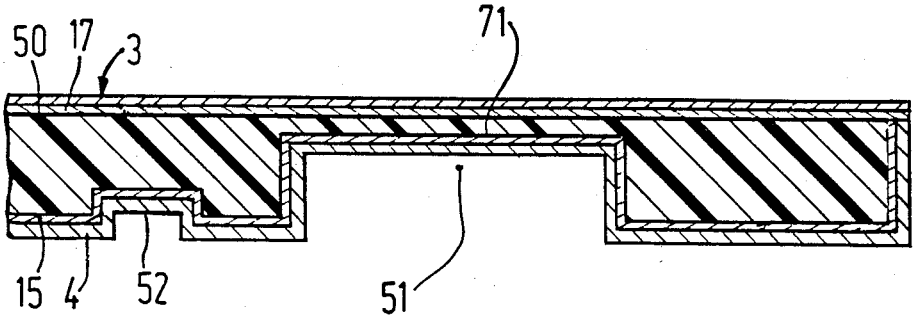

In a second embodiment of the method according to the invention the mould may be manufactured by stamping a sheet metal as shown in FIGS. 4*a*, 4*b* and 4*c*. This latter technique presents a certain number of additional advantages. In the first place, a smaller quantity of metallic material is used to manufacture the moulds, which reduces the cost and facilitates the operation in the case of large members which are less easy to handle. On the other hand, stamping is a simpler operation which is less expensive than machining. In fact, in the case of a series production a large number of moulds are necessary and a low cost of manufacture of the moulds is desired for the same reason as a small cost of the pieces themselves. Moreover, the stamped metal sheet has a surface which enables elimination of the polishing operation. Finally, the stamped sheet metal is flexible and facilitates the removal from the mould.

Apart from the simplifications and particularities described above, the performance of the method according to the invention by means of moulds of stamped sheet metal is conducted as has been described for the moulding by means of machined moulds.

Which method is chosen depends on the required precision.

It is to be noted that in many cases a stamped mould might be used instead of the more precise machined mould. In fact, the precision lost on the stamped mould is earned by the moulding since the intermediate layer destined to facilitate the removal from the mould in the method according to the invention has a negligible thickness, it being a simple passivating layer.

It will be obvious that on the one hand the use of the invention for the manufacture of members for flat hyperfrequency aerials is not limitative and that the invention may be applied to the manufacture of other types of aerials or to that of other types of bodies of moulded and metallized plastics and that on the other hand numerous variations are possible notably in the choice of the forms and of the materials without departing from the scope of the present invention as defined by the claims.

What is claimed is:

1. A method of manufacturing a molded body of plastic material covered with a metallic layer, comprising the steps of:
   (a) electrolytically depositing the metallic layer on a passivated inner surface of a metallic mold, said passivated inner surface forming a uniform intermediate layer of a composition to which the deposited metallic layer has poor adhesion;
   (b) introducing the plastic material into the mold to form the molded body; and
   (c) after the plastic material hardens, bringing the mold and the molded body to respective temperatures at which said body and the metallic layer adhering thereto separate from the mold.

2. A method as claimed in claim 1, characterized in that the metallic mould is manufactured from a solid metallic member by machining and its surface is polished electrolytically.

3. A method as claimed in claim 1, characterized in that the mould is of a stamped sheet metal.

4. A method as claimed in claim 1, 2 or 3, characterized in that the plastic material consists essentially of a thermocurable resin which is poured into the mould.

5. A method as claimed in claim 1, 2 or 3, characterized in that the plastic material consists essentially of a thermoplastic resin which is injected into the mould while hot.

6. A method as claimed in claim 1, 2 or 3, characterized in that the mould is of an iron-nickel-chromium alloy pasivated chemically and in that the mould is cooled to effect separation of the moulded body from the mould.

7. A method as claimed in claim 1, 2 or 3, characterized in that the mould is of aluminium passivated by a layer of oxide and in that the mould is heated to effect separation of the moulded body from the mould.

8. A method as claimed in claim 1, 2 or 3 characterized in that the metallic layer is a composition of copper, or silver, or gold, with nickel.

* * * * *